United States Patent [19]

Houžvic et al.

[11] Patent Number: 4,899,684

[45] Date of Patent: Feb. 13, 1990

[54] PRESSURE INDICATING BOTTLE STOPPER

[75] Inventors: Vladimír Houžvic; Jiří Jakl, both of Praha, Czechoslovakia

[73] Assignee: Jednotne Rolnicke Druzstvo Jedlova Vo Vysnej Jedlovej, Czechoslovakia

[21] Appl. No.: 232,943

[22] Filed: Aug. 17, 1988

[30] Foreign Application Priority Data

Aug. 17, 1987 [CS] Czechoslovakia ..... PV6040-87

[51] Int. Cl.[4] ..... G01L 7/16

[52] U.S. Cl. ..... 116/272; 116/266; 73/744

[58] Field of Search ..... 116/266, 272, DIG. 7, 116/270; 215/230, 260, 261, 271, 307; 220/352, DIG. 16, 66, 239, 203, 209; 73/52, 744, 146.8

[56] References Cited

U.S. PATENT DOCUMENTS

| | | | |
|---|---|---|---|
| 1,363,804 | 12/1920 | Mohn | 215/260 |
| 2,630,112 | 3/1953 | Zide | 116/266 |
| 2,827,122 | 3/1958 | Clark | 116/272 |
| 2,986,297 | 5/1961 | Pollick | 215/271 |
| 3,448,620 | 6/1969 | Ryan | 116/266 |
| 3,736,899 | 6/1973 | Manske | 116/70 |
| 3,930,592 | 1/1976 | Dilanni | 220/270 |
| 4,558,795 | 12/1985 | Logue | 215/260 |

FOREIGN PATENT DOCUMENTS

| | | | |
|---|---|---|---|
| 662889 | 12/1951 | United Kingdom | 220/209 |

*Primary Examiner*—William A. Cuchlinski, Jr.
*Assistant Examiner*—W. Morris Worth
*Attorney, Agent, or Firm*—Waldron & Associates

[57] ABSTRACT

The invention relates to the inspection of pressure attained in bottles with beverages, especially sparkling wines, by providing a pressure indicator and a deformation member in the carrier stopper body. In the body is provided a movable pressure indicator (2) while between the carrier body (1) and the indicator (2) there is interposed at least one deformation member (3) for influencing the magnitude of an indicator position change relative to the position of the body (1).

3 Claims, 2 Drawing Sheets

PRESSURE INDICATING BOTTLE STOPPER

BACKGROUND OF THE INVENTION

The invention relates to an improved structure of bottle stopper allowing the indication of pressure in bottles filled up with beverages such as sparkling wine as well as desired pressure inspection.

One of the main conditions to be complied with for maintaining the standard quality of sparkling wine in the production thereof is to ensure that the pressure, after the last stopping (or after spraying-off), may rise to a desired value of, say, 0.5 MPa. Heretofore no practical method how to ascertain or verify the pressure produced in the bottles, has been known.

The quality inspection is usually effected so that a certain number of bottles are opened, and particularly, either sporadically, or every n-th bottle. Apart from the fact that wine in such opened bottles is depreciated, this method does not exclude the possibility of delivering low-grade wine products.

SUMMARY OF THE INVENTION

To eliminate the drawbacks of prior art as hereinabove referred to, the present invention provides a pressure indicating bottle stopper having an external carrier body for sealing the bottle neck. According to the invention, a movable pressure indicator is arranged in said carrier body, and between the carrier body and the pressure indicator there is interposed at least one deformation member for influencing the magnitude of an indicator position change relative to the position of the carrier body.

Since the indicator is provided with a scale, an overpressure can exactly be read thereon. According to an embodiment of the invention, it is made possible to raise the sealing pressure between the indicator, the carrier body and the bottle neck in that the stopper is provided with a draw-in device which enables the contact pressure between the indicator and the carrier body of the stopper to be raised. If using the deformation member having a conical sealing surface it is possible, by forcing the indicator against the pressure action direction, to loosen the sealing, to de-pressurize the bottle, or, optionally, to spray off the filling.

An essential advantage of the stopper according to the invention consists in that the pressure to be reached in the bottles can be very easily inspected visually and that it is possible, by reading off the indicator scale, to ascertain an overpressure in the bottle with a sufficient preciseness. Other advantages reside in a great plurality of stopper structure variants, in the possibility of raising the sealing pressure, and depressurizing and spraying off the contents. The fundamental stopper parts can consist of several pieces, or be composed of an integral element. The deformation member can also operate upon the principle of losing the stability of spherical cap loaded by an external overpressure. Another advantage is the easy manufacture and inexpensiveness of the stopper if using suitable, hygienically harmless plastic materials for the manufacture thereof. Since the individual stopper parts are mostly bodies of revolution, also the manufacture of moulds therefor as well as production experimentation are relatively very inexpensive.

BRIEF DESCRIPTION OF THE INVENTION

In order that the invention be better understood and carried into practice, some preferred embodiments will hereinafter be described, by way of example, with reference to the accompanying schematic drawings in which:

FIGS. 1 through 4 show various axial sectional views of stoppers of the invention, produced by a method of precisely mould injecting from thermoplastics materials with viscoelastic properties.

DESCRIPTION OF THE PREFERRED EMBODIMENTS

Figure 1:
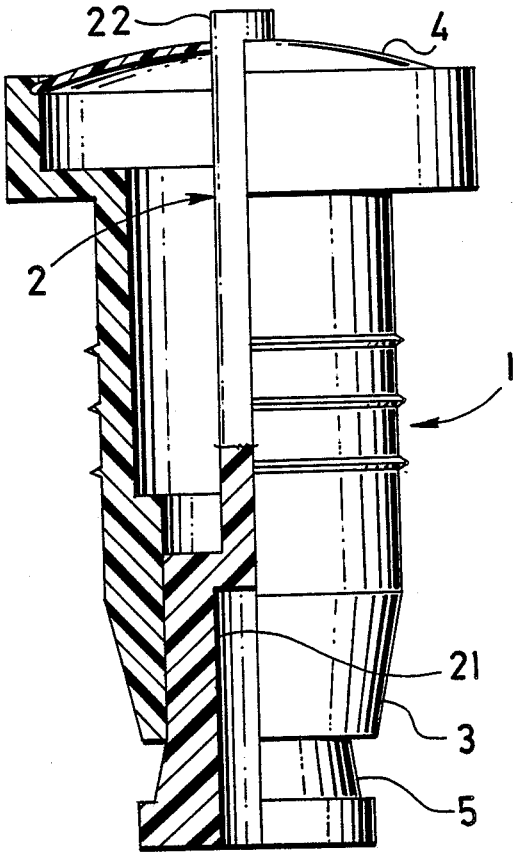

FIG. 1 shows a stopper whose carrier body 1 has a conventional standard form including outer sealing collars in the active portion , and an extended top end portion above the bottle neck. The latter is provided with a decorative cover 4. In the cover 4 there is provided a central hole through which the rod 22 of an indicator 2 passes. Another, lower active part 21 of the indicator 2 constitutes substantially another stopper inserted from below into the carrier body 1 opened at the bottom.

The lower end of the carrier body 1 which actually constitutes a deformation member 3, is moderately tapered at its external side so that after driving the stopper into the bottle neck, a play is left between the bottle neck and said lower end of the carrier body 1 whereby a space for the necessary deformation is provided for. Due to to an internal overpressure in the bottle, the indicator 2 is forced into said carrier body 1. The active portion 21 of the indicator merges into a cone 5 which, if moving upwards, deforms the deformation member 3. The length of this indicator motion depends on the magnitude of internal overpressure. As the overpressure in the bottle grows, both the motion and the resistance of the deformation member 3 increase so that the sealing effect of the active portion 21 as well as the friction between the carrier body 1 and the bottle neck rise. With the rigidity ratio in radial direction in view, the function of the deformation member is in this case partially assumed also by the active portion 21 of the indicator 2. The ascension of the rod 22 out of the cover 4 serves for the pressure indication.

Figure 2:
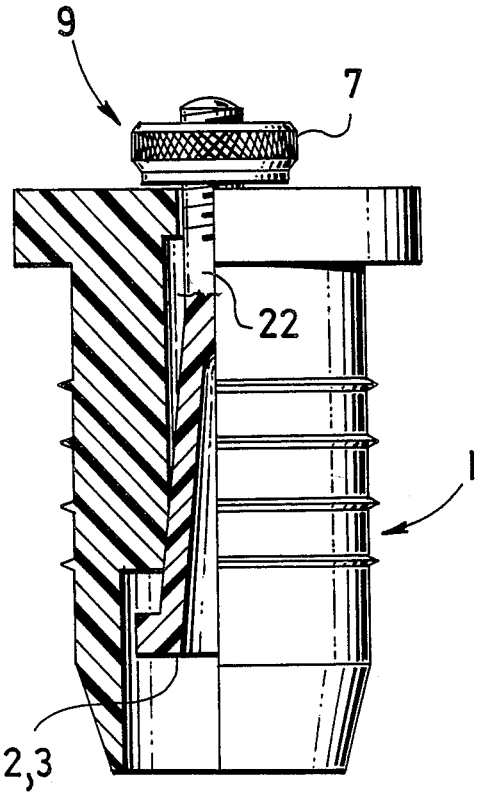

FIG. 2 shows another stopper embodiment, wherein the indicator 2 and the deformation member 3 are made as an integral element which is inserted from below into the carrier body 1. The deformation member 3 has the form of a hollow cone while the carrier body 1 the form of a hollow cylinder with a conical surface in the region of contact with said member 3. The top portion of the indicator which passes through an opening in the carrier body 1, is provided with a draw-in device 9, and particularly with a thread on the rod 22 and a nut 7. The nut has a mark line or a scale for reading off the shift arisen, and particularly by means of angle of rotation of said nut. While tightening the nut 7 it is possible to raise the sealing effect of the stopper when the bottle is not yet under pressure, whereas, on the other way about, the robust structure of the indicator 2 makes it possible, after partial loosening the nut 7, to force it in inward direction, to de-pressurize the bottle, or, optionally, to spray off some of the bottle contents.

Figure 3:
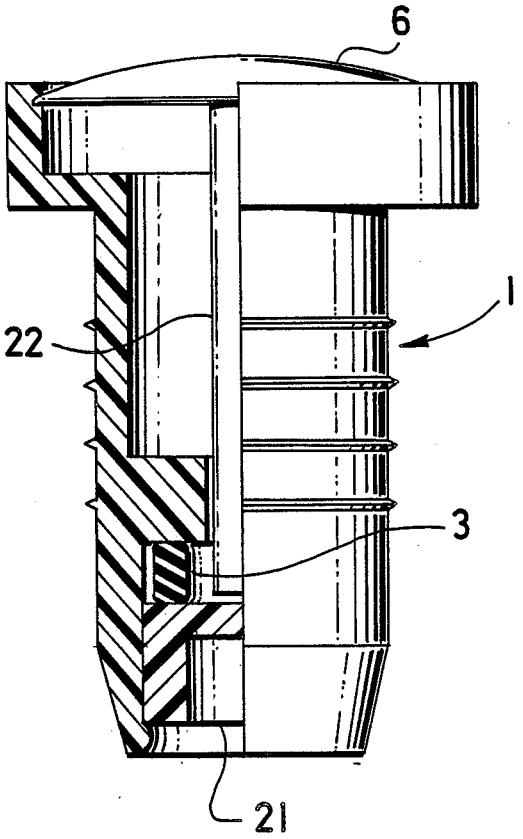

In the stopper embodiment as shown in FIG. 3, the pressure indicator 2 is composed of two independent parts, viz. the active portion 21 and the rod 22 which is provided with a roof 6 at its top end. The hollow carrier body 1 of the stopper has a usual external form whereas its internal profile, in its upper extended portion, is provided with a recess for receiving the roof 6, and in its intermediate and lower portions, the carrier body 1 is adapted to allow the free motion of the rod 22 and to positively guide the active portion 21. The deformation member is constituted by an independent element which is made of hygienically harmless rubber and simultaneously assumes the function of sealing means. In case of an internal overpressure the deformation member 3 gets deformed, the indicator is shifted, and the roof 6 is disengaged from the recess in the carrier body 1, which is fairly sufficient for a very quick visual inspection of the bottles in which the necessary overpressure has arisen.

Figure 4:
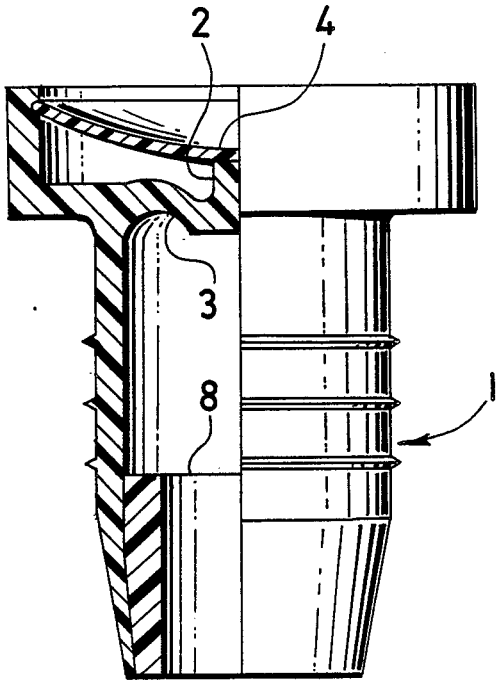

FIG. 4 shows a stopper embodiment, wherein the carrier body 1, the indicator 2 and the deformation member 3 form an integral element. Due to an internal overpressure, the deformation member in shape of an undulated circular plate gets deformed and the indicator 2 is displaced whereby it ejects the decorative cover 4 from the recess in the extended top portion of the carrier body 1. The missing cover 4 then proves that a desired pressure in the bottle has been reached. For technological reasons, the carrier body 1 is reinforced by a separate box 8.

We claim:

1. A pressure indicating bottle stopper comprising a generally cylindrical external carrier body formed of a deformable viscoelastic material adapted to be tightly inserted into a bottle neck to seal said bottle, said carrier body having an axial opening extending therethrough, an elongated indicator body disposed within said opening such that an upper end thereof extends beyond said carrier body, a lower peripheral portion of said indicator body being conically tapered and adapted to circumferentially engage said external carrier body within said opening to thereby seal said opening, and said indicator body adapted to be moved in a first direction further into said opening in response to an increase in pressure within said bottle to thereby outwardly and elastically deform said carrier body, the magnitude of said movement being in proportion to the magnitude of said pressure increase and discernable by the change in position of said upper end of said indicator body relative to the carrier body, said opening further remaining sealed during movement of said indicator body in said first direction.

2. A bottle stopper according to claim 1 wherein said upper end of said indicator body supports a draw-in means to permit the manual raising and or lowering of said indicator body with respect to said carrier body.

3. A bottle stopper according to claim 1 wherein said indicator body is provided with a scale to indicate its position relative to said carrier body.

* * * * *